US010522063B2

(12) United States Patent
Tanahara

(10) Patent No.: US 10,522,063 B2
(45) Date of Patent: Dec. 31, 2019

(54) DISPLAY DEVICE

(71) Applicant: Mitsubishi Electric Corporation, Tokyo (JP)

(72) Inventor: Manabu Tanahara, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 24 days.

(21) Appl. No.: 15/435,010

(22) Filed: Feb. 16, 2017

(65) Prior Publication Data

US 2017/0249883 A1 Aug. 31, 2017

(30) Foreign Application Priority Data

Feb. 26, 2016 (JP) ..... 2016-035246

(51) Int. Cl.
*G09G 3/00* (2006.01)
*G09G 3/36* (2006.01)

(52) U.S. Cl.
CPC ..... *G09G 3/006* (2013.01); *G09G 3/3648* (2013.01); *G09G 3/3696* (2013.01); *G09G 2300/0819* (2013.01); *G09G 2330/12* (2013.01)

(58) Field of Classification Search
None
See application file for complete search history.

(56) References Cited

U.S. PATENT DOCUMENTS 6,624,857 B1 9/2003 Nagata et al.
6,882,378 B2 4/2005 Nagata et al.
2011/0279746 A1* 11/2011 Kim ..... G02F 1/136259 349/54
2013/0176251 A1* 7/2013 Wyatt ..... G06F 3/0416 345/173
2013/0222359 A1* 8/2013 Nakata ..... G09G 3/3614 345/212
2014/0191930 A1* 7/2014 Okumoto ..... G09G 3/006 345/55

FOREIGN PATENT DOCUMENTS

JP H11-338376 A 12/1999

* cited by examiner

*Primary Examiner* — Ifedayo B Iluyomade
(74) *Attorney, Agent, or Firm* — Studebaker & Brackett PC

(57) ABSTRACT

In a display period, a display device applies a voltage of a level for turning a state of an inspection switching element to an OFF state to a gate electrode of the inspection switching element. Moreover, in a vertical blanking period while a state of a switching element is the OFF state, the display device performs voltage application processing for applying a voltage, which indicates an ON level, or a voltage, which indicates a level between the ON level and an OFF level, to the gate electrode of the switching element.

4 Claims, 7 Drawing Sheets

DISPLAY DEVICE

BACKGROUND OF THE INVENTION

Field of the Invention

The present invention relates to a display device having a configuration of inspecting elements.

Description of the Background Art

In usual, in a liquid crystal display device, liquid crystal is sealed into a space formed of: two electrode substrates laminated to each other by a sealant; and the sealant. Transparent electrodes are formed on the respective electrode substrates. Moreover, the sealant is formed on a periphery of a display region for displaying a video. Hereinafter, a region on the periphery of the display region will also be referred to as a "peripheral region". The peripheral region is a region that surrounds the display region when viewed as a plane (XY plane) from the above. The peripheral region is also a frame region of the liquid crystal display device.

Moreover, a drive system of the liquid crystal display device includes an active matrix type and a passive matrix type. An active matrix-type liquid crystal display device has a TFT array substrate in which thin film transistors as switching elements are formed in a matrix. In the liquid crystal display device, the TFT array substrate and a counter substrate are laminated to each other through the sealant. The liquid crystal is sealed between the TFT array substrate and the counter substrate.

On the display region of the TFT array substrate, there are provided gate wires, source wires, pixel electrodes and the like. By a gate signal that propagate through the gate wires, a state of the TFT as the switching element is set to an ON state or an OFF state. A source signal that propagates through the source wires is supplied to the pixel electrodes through the TFTs.

Then, when the source signal is supplied to each of the pixel electrodes, a display voltage, which corresponds to the source signal, is applied between the counter electrode and the pixel electrode. In this way, the liquid crystal is driven. The gate signal that propagate through the gate wires and the source signal that propagates through the source wires are supplied from driver ICs.

Hence, on the peripheral region, there are formed wires for connecting the driver ICs and the gate wires and the source wires to each other. Moreover, the sealant and common wires are formed on the peripheral region. A common signal for giving a common potential to the counter substrate is propagated through the common wires.

In order to confirm whether or not the liquid crystal display device operates normally, a configuration (hereinafter, also referred to as an "inspection configuration") for performing a variety of inspections is usually provided in the liquid crystal display device concerned. In JP 11-338376 A, a liquid crystal display panel (device) provided with the inspection configuration is disclosed. Moreover, in JP 11-338376 A, a technology (hereinafter, also referred to as "Related Art A") using the inspection configuration is disclosed.

In Related Art A, inspection signals are transmitted from inspection terminals to a plurality of scanning lines (gate wires) and a plurality of data lines (source wires). Then, a plurality of inspection TFTs provided between the inspection terminals and the plurality of scanning lines and between the inspection terminals and the plurality of data lines are controlled, whereby the variety of inspections are performed. In Related Art A, there is disclosed a configuration capable of inspection by several inspection signals by collectively controlling the plurality of inspection TFTs.

In Related Art A, when the liquid crystal display panel (liquid crystal display device) is driven, a constant-level voltage for turning the inspection TFTs to an OFF state is applied to the inspection TFTs concerned.

In general, as a period while the same level-voltage is being applied to the inspection switching elements (inspection TFTs) is longer, a change of a threshold value of the inspection switching elements is increased. That is to say, as the period while the same level-voltage is being applied to the inspection switching elements is longer, a state of the inspection switching elements turns to an ON state in some case by an unexpected voltage from an outside.

In this case, there is a problem that a malfunction that quality of a video decreases occurs since unnecessary currents (leak currents) flow from the inspection switching elements in the ON state to the switching elements for displaying the video.

Therefore, in order to prevent such a malfunction described above, it is required to suppress prolongation of the period while the same level-voltage is applied to the inspection switching elements no matter whether the period concerned may be a period while a display device such as the liquid crystal display device is displaying a video or may be a period while the display device is not displaying the video.

SUMMARY OF THE INVENTION

It is an object of the present invention to provide a display device in which the prolongation of the period while the same-level voltage is applied to the inspection switching elements is suppressed.

A display device according to an aspect of the present invention displays a video. The display device includes: a first switching element for use in displaying the video; and a second switching element for inspecting a state of the first switching element, wherein the display device displays the video by driving the first switching element, a switching element that is each of the first switching element and the second switching element has a first electrode, a second electrode and a third electrode, a state of the switching element includes: an ON state where the first electrode and second electrode of the switching element are electrically connected to each other; and an OFF state where the first electrode and second electrode of the switching element are not electrically connected to each other, the third electrode is an electrode to be selectively applied with a first voltage that is a voltage for turning the state of the switching element to the ON state and a second voltage that is a voltage for turning the state of the switching element to the OFF state, the second electrode of the second switching element is connected to the first switching element, in a display period that is a period while the display device is displaying the video, the display device applies an OFF second voltage, which is the second voltage for turning a state of the second switching element that is the switching element to the OFF state, to the third electrode of the second switching element, and in a period while a state of the first switching element is the OFF state, the display device performs voltage application processing for applying a third voltage, which indicates a value between a value of the OFF second voltage and a value of the first voltage, to the third electrode of the second switching element.

In accordance with the present invention, in the display period, the display device applies the OFF second voltage for turning the state of the second switching element to the OFF state to the third electrode of the second switching element.

Moreover, in the period while the state of the first switching element is the OFF state, the display device performs voltage application processing for applying the first voltage or the third voltage, which indicates a value between a value of the OFF second voltage and a value of the first voltage, to the third electrode of the second switching element.

Note that the period while the state of the first switching element is the OFF state is a period while the first switching element for use in displaying the video is not used (that is, a period while the video is not displayed).

In accordance with the above, there can be suppressed prolongation of a period while the same-level voltage is applied to the second switching element for inspecting the state of the first switching element.

These and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
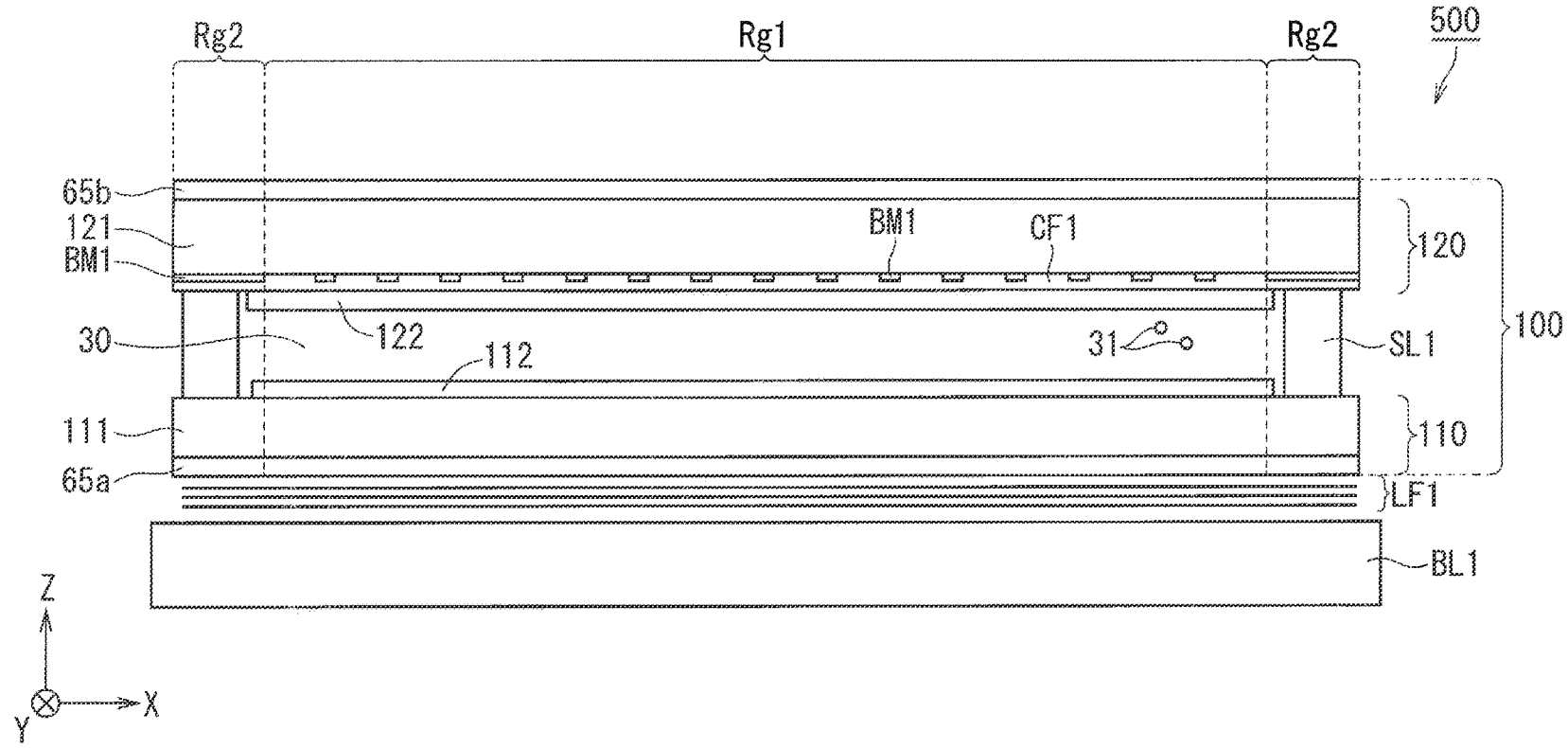
FIG. 1 is a cross-sectional view of a display device according to a first preferred embodiment of the present invention.

Hereinafter, preferred embodiments of the present invention will be described while referring to the drawings. In the drawings referred to below, the same reference numerals are assigned to the same constituents. Names and functions of the respective constituents to which the same reference numerals are assigned are the same. Hence, a detailed description of a part of the respective constituents to which the same reference numerals are assigned is omitted in some case.

The following description describes the preferred embodiments of the present invention, and the present invention is not limited to the following preferred embodiments. Moreover, in order to clarify the explanation, the following description and the drawings are subjected to omission and simplification as appropriate.

Note that dimensions, materials and shapes of the respective constituents illustrated in the preferred embodiments, relative arrangement of the respective constituents, and the like may be appropriately changed depending on a configuration of a device to which the present invention is applied, a variety of conditions and the like. Moreover, dimensions of the respective constituents in the respective drawings are different from actual dimensions in some case.

First Preferred Embodiment (Basic Configuration of Whole of Display Device)

FIG. 1 is a cross-sectional view of a display device 500 according to a first preferred embodiment of the present invention. For example, the display device 500 is a liquid crystal display device that displays a video by using liquid crystal. Note that the display device 500 is not limited to the liquid crystal display device, and may be a display device of another system. For example, the display device 500 may be an organic electroluminescence (EL) display.

In FIG. 1, an X direction, a V direction and a Z direction are perpendicular to one another. An X direction, a Y direction and a Z direction in each of the drawings subsequent to FIG. 1 are also perpendicular to one another. Hereinbelow, a direction including the X direction and a direction opposite to the X direction (−X direction) is also referred to as an "X-axis direction". Moreover, hereinbelow, a direction including the direction and a direction opposite to the Y direction (−Y direction) is also referred to as a "Y-axis direction". Moreover, hereinbelow, a direction including the Z direction and a direction opposite to the Z direction (−Z direction) is also referred to as a "Z-axis direction".

Moreover, hereinbelow, a plane including the X-axis direction and the Y-axis direction is also referred to as an "XY plane". Moreover, hereinbelow, a plane including the X-axis direction and the Z-axis direction is also referred to as an "XZ plane". Moreover, hereinbelow, a plane including the Y-axis direction and the Z-axis direction is also referred to as a "YZ plane".

Figure 2:
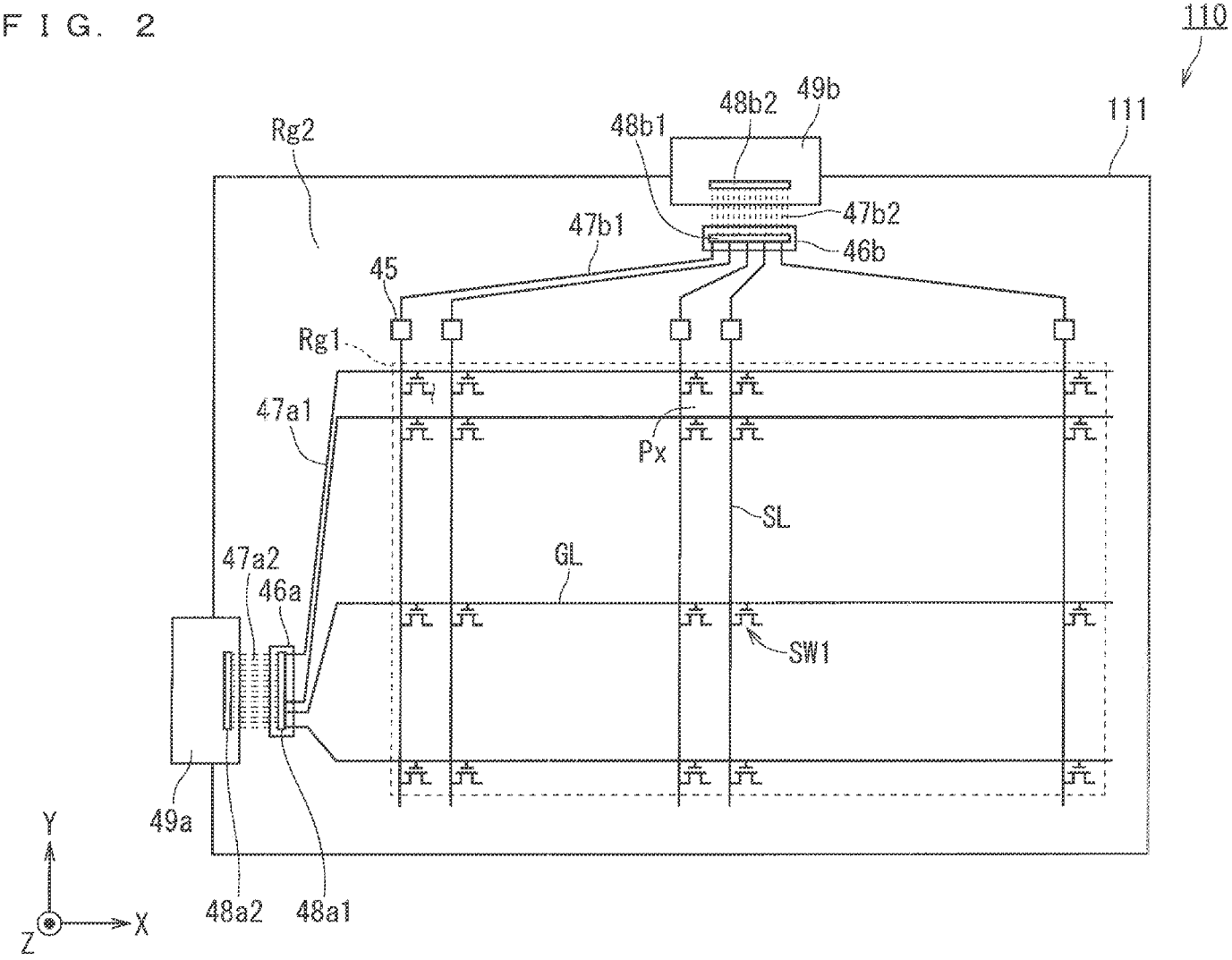
FIG. 2 is a plan view showing a configuration of a substrate to be described later, the substrate being included in the display device according to the first preferred embodiment of the present invention.

FIG. 2 is a plan view showing a configuration of a substrate 110 to be described later, the substrate being included in the display device 500 according to the first preferred embodiment of the present invention.

Referring to FIG. 1 and FIG. 2, the display device 500 includes a display panel 100, a backlight unit BL1 and an optical film LF1. For example, the display panel 100 is a liquid crystal panel of a fringe field switching (FFS) mode.

Note that the display panel 100 is not limited to the liquid crystal panel, and may be a panel of another system. For example, the display panel 100 may be an organic EL panel.

The display panel 100 is a panel for displaying a video. Hereinafter, in the display panel 100, a side thereof on which the video is displayed is also referred to as a "visual recognition side". Moreover, hereinafter, in the display panel 100, a side thereof on which the video is not displayed is also referred to as a "non-visual recognition side".

The backlight unit BL1 emits light to be used for allowing the display panel 100 to display the video. The backlight unit BL1 is provided on the non-visual recognition side of the display panel 100. The optical film LF1 is provided between the display panel 100 and the backlight unit BL1. For example, the optical film LF1 is composed of a phase difference plate or the like.

Hereinafter, the light emitted from the backlight unit BL1 is also referred to as "light La". The light La is light that propagates in the Z-axis direction from the backlight unit BL1. The display panel 100 displays the video by using the light La emitted from the backlight unit BL1.

Note that the display device 500 further includes a housing (not shown). The housing is composed of resin, metal or the like. The housing of the display device 500 houses the respective constituents which the display device 500 concerned includes. For example, the respective constituents concerned are the display panel 100, the backlight unit BL1, and the optical film LF1.

The display panel 100 includes substrates 110 and 120 and a liquid crystal layer 30. Each of the substrates 110 and 120 has transparency. The substrate 110 is an array substrate having a configuration for controlling the liquid crystal layer 30. The substrate 120 is provided on the visual recognition side of the display panel 100. The substrate 120 is a color filter substrate that emits light, which transmits through the substrate 120 concerned, as colored light. For example, the colored light is red light, green light, and blue light.

The substrate 110 and the substrate 120 are laminated to each other by a sealant SL1. That is to say, the display panel 100 has a structure in which the substrate 110 and the substrate 120 are laminated to each other by the sealant SL1. That is to say, the substrate 120 is a counter substrate opposite to the substrate 110. A shape of the sealant SL1 when the sealant SL1 is viewed as a plane (XY plane) from the above is a closed loop shape (frame-like).

The liquid crystal layer 30 includes a plurality of liquid crystal molecules 31. Note that, in order to make it easy to see the configuration, FIG. 1 shows only two liquid crystal molecules 31; however, in actual, the liquid crystal layer 30 includes extremely many liquid crystal molecules 31. The liquid crystal layer 30 is sealed into a region (space) formed of the substrate 110, the substrate 120 and the sealant SL1.

The display panel 100 includes a display region Rg1 and a peripheral region (frame region) Rg2. The display region Rg1 is a region for allowing the display panel 100 to display the video when the display panel 100 is viewed as a plane (XY plane) from the above. The display region Rg1 includes a plurality of pixel portions (not shown) arranged in a matrix when the display region Rg1 is viewed as a plane (XY plane) from the above. The display panel 100 displays the video by using the plurality of pixel portions. The respective pixel portions concerned are composed of red pixels, green pixels and blue pixels.

Hereinafter, each of the red pixels, the green pixels and the blue pixels, which compose the pixel portions, is also referred to as a "pixel Px" or a "pixel". The pixel Px serves as a unit of displaying the video on display panel 100. The display region Rg1 is composed of a plurality of the pixels Px arranged in a matrix. That is to say, the display region Rg1 is composed of a plurality of the pixel portions arranged in a matrix. Moreover, hereinafter, a region on which the pixels are formed is also referred to as a "pixel region".

When viewed as a plane (XY plane) from the above, the peripheral region Rg2 is provided on a periphery of the display region Rg1. Specifically, the peripheral region Rg2 is a region that surrounds the display region Rg1 when the liquid crystal display device is viewed as a plane (XY plane) from the above. A shape of the peripheral region Rg2 when the liquid crystal display device is viewed as a plane (XY plane) from the above is a closed loop shape (frame-like).

Note that the display region Rg1 and the peripheral region Rg2 are also applied to a space where the display panel 100 is composed and to the XY plane, the XZ plane and the YZ plane in the space concerned in a similar way to the display panel 100. That is to say, the display region Rg1 and the peripheral region Rg2 are also applied to the respective constituents (substrates 110 and 120, liquid crystal layer 30 and the like), which compose the display panel 100, in a similar way to the display panel 100. Therefore, for example, as shown in FIG. 1, the substrate 110 of the display panel 100 has the display region Rg1 and the peripheral region Rg2.

Next, a description will be made of the substrate 110, which serves as the array substrate, in detail. Referring to FIG. 1 and FIG. 2, the substrate 110 includes: a plurality of gate wires GL; a plurality of source wires SL; a transparent substrate 111; a plurality of switching elements SW1; a plurality of pixel electrodes GE1; a polarizing plate 65*a*; and an oriented film 112.

Note that, in order to make it easy to understand the configuration, FIG. 2 shows four gate wires GL and five source wires SL. However, in actual, the substrate 110 includes n (integer of 5 or more) pieces of the gate wires GL and s (integer of 6 or more) pieces of the source wires SL.

Though details will be described later, the respective gate wires GL and the respective source wires SL are wires for transmitting signals, which serve for controlling the respective switching elements SW1, to the respective switching elements SW1. By using the signals concerned, the respective switching elements SW1 supply voltages to the pixel electrodes GE1 to be described later.

The respective gate wires GL are provided in parallel to one another on the display region Rg1. Specifically, as shown in FIG. 2, on the display region Rg1 of the substrate 110, the respective gate wires GL are provided so as to be extended in a row direction (X-axis direction). The respective gate wires GL function as scanning signal lines.

Moreover, the respective source wires SL are provided in parallel to one another on the display region Rg1. Specifically, as shown in FIG. 2, on the display region Rg1, the respective source wires SL are provided so as to be extended in a column direction (Y-axis direction). The respective source wires SL function as display signal lines. Rectangles, which are formed of the plurality of gate wires GL and the plurality of source wires SL, correspond to the "pixels Px".

The switching elements SW1 are provided in the respective pixels Px which compose the display region Rg1 of the substrate 110. That is to say, the respective switching elements SW1 are provided in a matrix. Specifically, the switching elements SW1 are provided in vicinities of portions where the respective gate wires GL and the respective source wires SL intersect each other. Note that, since the respective switching elements SW1 are provided in an array (matrix) shape on the display region Rg1, the display region Rg1 is also referred to as an "array region".

The polarizing plate 65*a* has a transmission axis and an absorption axis, which are perpendicular to each other. The polarizing plate 65*a* absorbs light that oscillates along the absorption axis. That is to say, the polarizing plate 65*a* does not transmit the light that oscillates along the absorption axis of the polarizing plate 65*a* concerned.

The transparent substrate 111 has transparency. The transparent substrate 111 is composed of an insulating material. For example, the transparent substrate 111 is a glass substrate, a semiconductor substrate or the like. On one surface of the transparent substrate 111, the plurality of switching elements SW1 are provided. Note that the above-mentioned polarizing plate 65*a* is provided on other surface of the transparent substrate 111.

For example, each of the switching elements SW1 is a thin film transistor (TFT) composed of amorphous silicon, an oxide semiconductor and the like. Specifically, for example, each switching element SW1 is an N-channel-type metal-oxide-semiconductor field-effect transistor (MOSFET).

Each of the switching elements SW1 has a drain electrode, a source electrode and a gate electrode. Hereinafter, a state where the drain electrode and source electrode of the switching element SW1 are electrically connected to each other is also referred to as an "ON state". Hereinafter, a state where the drain electrode and source electrode of the switching element SW1 are not electrically connected to each other is also referred to as an "OFF state". The ON state and the OFF state are present in a state of the switching element SW1.

Each of the switching elements SW1 is set to the ON state or the OFF state. Note that each switching element SW1 may be a P-channel-type MOSFET.

A pixel electrode GE1 (not shown) to be described later is connected to each of the switching elements SW1. Specifically, the pixel electrode GE1 to be described later is connected to the drain electrode of each switching element SW1.

Each of the pixel electrodes GE1 is provided so as to correspond to each of the pixels Px of the display region Rg1. Each of the pixel electrodes GE1 is an electrode for generating an electric field in the liquid crystal layer 30 in such a manner that a voltage is applied to the pixel electrode GE1 concerned. Specifically, each of the pixel electrodes GE1 is used for generating such an electric field for changing an orientation of the liquid crystal molecules 31 in the liquid crystal layer 30. A shape of the pixel electrode GE1 is flat. For example, the pixel electrode GE1 is a transparent conductive film pattern composed of a transparent conductive film made of indium tin oxide (ITO) or the like.

The oriented film 112 is a film for orienting the liquid crystal molecules 31. The oriented film 112 is provided on the one surface of the transparent substrate 111.

Next, a description will be made of the substrate 120, which serves as the color filter substrate, in detail. Referring to FIG. 1, the substrate 120 includes: a polarizing plate 65*b*; a transparent substrate 121; color filters CF1; a black matrix BM1; a common electrode (counter electrode; not shown); and an oriented film 122.

The polarizing plate 65*b* is a plate having the same function and configuration as those of the polarizing plate 65*a*. The transparent substrate 121 is a transparent substrate having transparency. On one surface of the transparent substrate 121, the color filters CF1 and the black matrix BM1 are provided. Note that the polarizing plate 65*b* is provided on the other surface of the transparent substrate 121.

The black matrix BM1 is a light shielding member that shields a part of light. Moreover, the black matrix BM1 is provided on the peripheral region Rg2 so that the light cannot transmit through the peripheral region Rg2 which the substrate 120 has.

The common electrode (counter electrode; not shown) is provided so as to cover the black matrix BM1 and the respective color filters CF1. The common electrode is provided so as to be opposite to the respective pixel electrodes GE1 through an insulating film. For example, slits are provided in the common electrode.

The oriented film 122 is a film for orienting the liquid crystal molecules 31. The oriented film 122 is provided so that the oriented film 122 concerned can cover a part of the common electrode (not shown) in the display region Rg1.

Next, a description will be made in detail of an electric configuration of the substrate 110. Referring to FIG. 2, on the peripheral region Rg2 of the substrate 110, there are provided: a scanning signal drive circuit 46*a*; a display signal drive circuit 46*b*; a wire conversion unit 45; lead wires 47*a*1, 47*a*2, 47*b*1 and 47*b*2; and external connection terminals 48*a*1, 48*a*2, 48*b*1 and 48*b*2.

The gate wires GL extend from the display region Rg1 to the peripheral region Rg2. The gate wires GL are connected to the lead wires 47*a*1. A material for composing the lead wires 47*a*1 is the same as a material for composing the gate wires GL. The lead wires 47*a*1 are connected to the scanning signal drive circuit 46*a* through the external connection terminal 48*a*1.

The source wires SL extend from the display region Rg1 to the peripheral region Rg2. The source wires SL are connected to the lead wires 47*b*1 through the wire conversion unit 45. A material for composing the lead wires 47*b*1 is the same as a material for composing the source wires SL. The lead wires 47*b*1 are formed in a layer where the gate wires GL are disposed. For example, the lead wires 47*b*1 are formed of conductive films. The source wires SL are electrically connected to a conductive film of the external connection terminal 48*b*1. The lead wires 47*a*1 are connected to the display signal drive circuit 46*b* through the external connection terminal 48*b*1.

To a vicinity of the scanning signal drive circuit 46*a*, an external wire 49*a* is connected through the lead wires 47*a*2 and the external connection terminal 48*a*2. Moreover, to a vicinity of the display signal drive circuit 46*b*, an external wire 49*b* is connected through the lead wires 47*b*2 and the external connection terminal 48*b*2. For example, the external wires 49*a* and 49*b* are wiring boards such as flexible printed circuits (FPCs).

To the scanning signal drive circuit 46*a*, a variety of signals from the outside are supplied through the external wire 49*a* and the lead wires 47*a*2. To the display signal drive circuit 46*b*, a variety of signals from the outside are supplied through the external wire 49*b* and the lead wires 47*b*2.

Based on a control signal from the outside, the scanning signal drive circuit. 46*a* sequentially supplies the gate signal (scanning signal) to the n pieces of gate wires GL. By the gate signal, the n pieces of gate wires GL are sequentially selected.

Based on the control signal or display data from the outside, the display signal drive circuit 46*b* supplies a display signal to a part or all of the s pieces of source wires SL. In this way, a display voltage corresponding to the display data can be supplied to each of the pixels Px. As mentioned above, the switching element SW1 is provided in each of the pixels Px.

For example, the switching element SW1 supplies a display potential to the pixel electrode GE1. Specifically, by the gate signal from the gate wire GL, the switching element SW1 is set to the ON state or the OFF state. In the switching element SW1 in the ON state, the display potential is applied from the source wire SL to the pixel electrode GE1 connected to the drain electrode of the switching element SW1 concerned.

Note that a common potential is supplied to the common electrode of the substrate 120. A fringe field corresponding to the display voltage is generated between the pixel electrode GE1 and the common electrode. The display voltage concerned is a voltage obtained by subtracting the common potential, which is supplied to the common electrode, from the display potential, which is supplied to the pixel electrode GE1.

Note that the liquid crystal is driven by the generation of the fringe field. That is to say, an orientation of the liquid crystal molecules 31 included in the liquid crystal layer 30 is changed. In this way, a polarization state of the light that passes through the liquid crystal layer 30 is changed. With regard to the light that has passed through the polarizing plate 65*a* and has become linearly polarized light, such a polarization state thereof is changed by the liquid crystal layer 30.

Specifically, the light La emitted from the backlight unit BL1 becomes the linearly polarized light by the polarizing plate 65*a* of the substrate 110. This linearly polarized light passes through the liquid crystal layer 30, whereby the polarization state thereof is changed. Depending on the polarization state of the light that has passed through the liquid crystal layer 30, an amount of light that passes through the polarizing plate 65*b* of the substrate 120 is changed.

That is to say, in transmitted light that transmits through the display panel 100 from the backlight unit BL1, the amount of light that passes through the polarizing plate 65*b* of the visual recognition side (substrate 120) of the display panel 100 is changed. The orientation of the liquid crystal molecules 31 is changed largely depending on a magnitude of the display voltage applied to the liquid crystal molecules 31 concerned. Hence, by controlling the display voltage, the display panel 100 can change the amount of light that passes through the polarizing plate 65*b* on the substrate 120 side of the display panel 100. That is to say, for each of the pixels Px, the display panel 100 changes the display voltage applied to the pixel Px concerned, and can thereby display a desired video on the display region Rg1.

Figure 3:
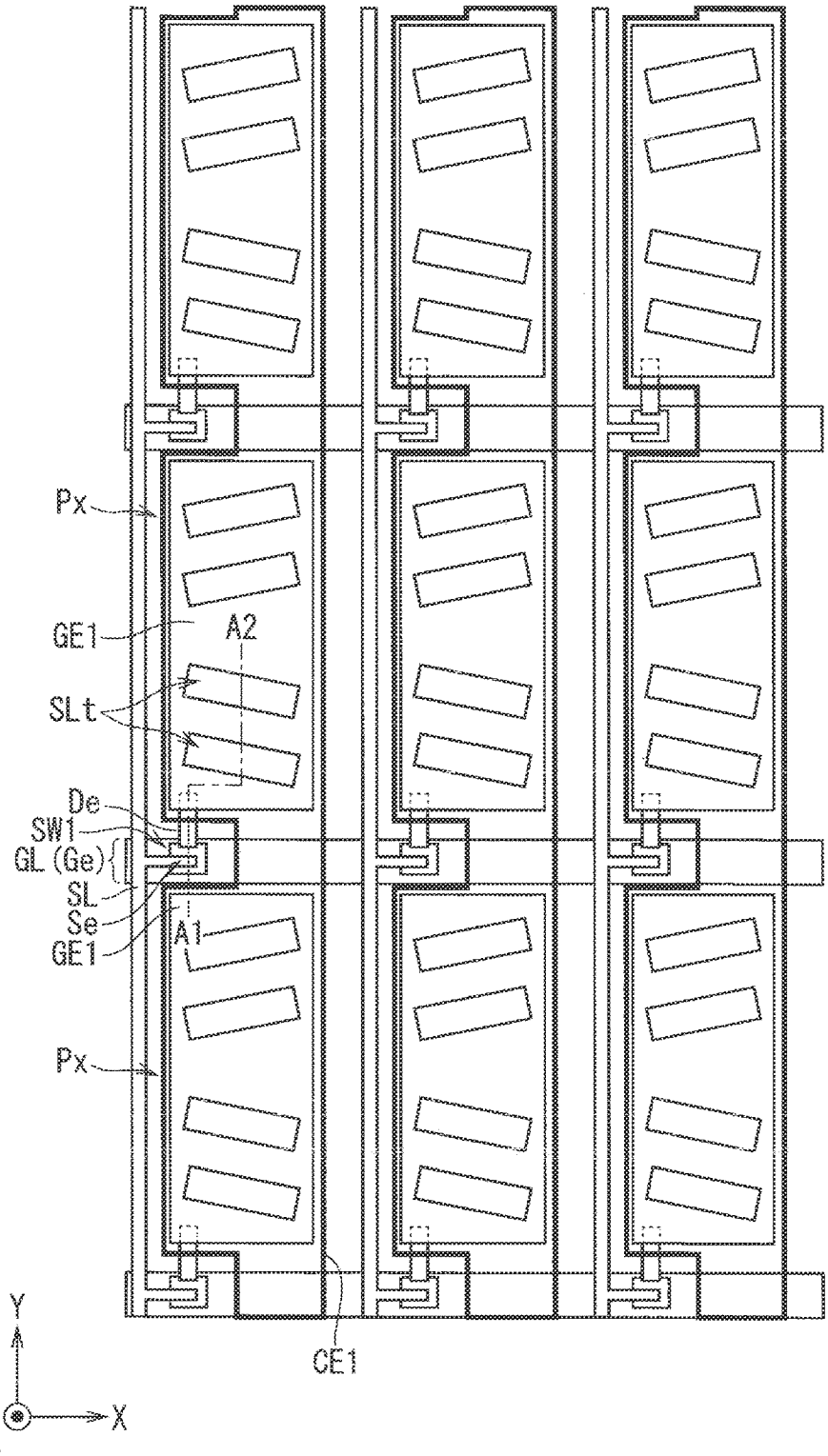
FIG. 3 is a plan view showing a pixel configuration of a center portion of a display region of the substrate.
Figure 4:
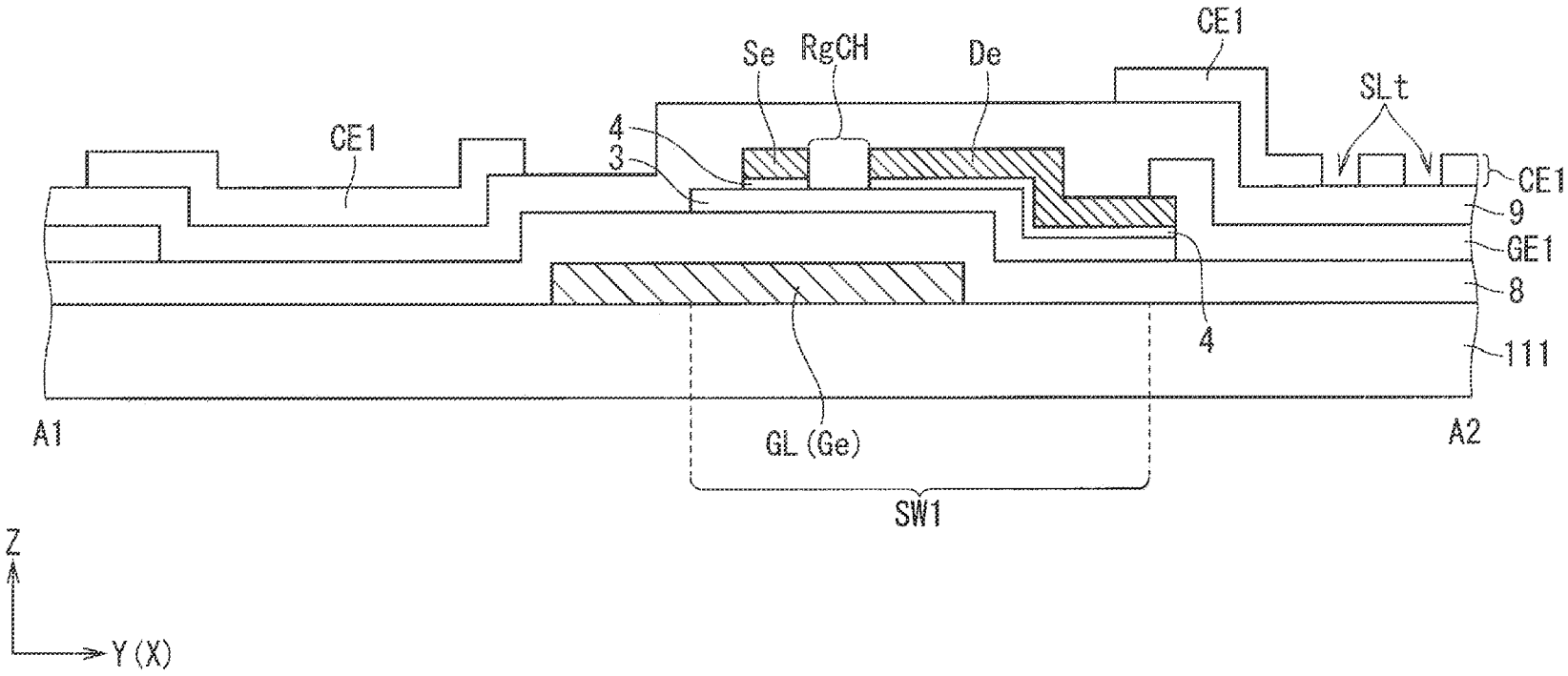
FIG. 4 is a cross-sectional view of a display panel, taken along line A1-A2 of FIG. 3.

Next, a description will be made of a detailed configuration of the display region Rg1 of the substrate 110 of the display panel 100 included in the display device 500 according to the first preferred embodiment. FIG. 3 is a plan view showing a pixel configuration of a center portion of the display region Rg1 of the substrate 110. FIG. 4 is a cross-sectional view of the display panel 100, taken along line A1-A2 of FIG. 3. Note that, in order to make it easy to understand the configuration, FIG. 3 does not show an insulating film 8, an interlayer insulating film 9, and a semiconductor layer 3, which will be described later.

Referring to FIG. 3 and FIG. 4, each of the switching elements SW1 includes: a gate electrode Ge; the insulating film 8; the semiconductor layer 3; an ohmic contact film 4; a source electrode Se; and a drain electrode De. The gate electrode Ge is a part of the gate wire GL.

The gate wire GL is formed of a conductive film. For example, the conductive film concerned is composed of high-melting-point metal, low-resistance metal or the like. Moreover, for example, the conductive film may be composed of an alloy film or a laminated film. The alloy film is a film containing the high-melting-point metal, the low-resistance metal or the like as a main component. The laminated film is a film in which pieces of the high-melting-point metal, the low-resistance metal or the like are laminated on each other. For example, the conductive film is composed by using Cr, Al, Ta, Ti, Mo, W, Ni, Cu, Au, or Ag.

On the transparent substrate 111, the gate wire GL is provided. The gate wire GL is connected to the gate electrode Ge of the switching element SW1. The insulating film 8 as a gate insulating film covers the gate wire GL.

The semiconductor layer 3 is provided on the insulating film 8. When viewed as a plane (XY plane) from the above, the semiconductor layer 3 is provided so as to overlap a part of the gate wire GL. The semiconductor layer 3 is composed of amorphous silicon, polycrystalline silicon or the like. On the semiconductor layer 3, an ohmic contact film 4 doped with conductive impurity is provided.

Specifically, the ohmic contact film 4 is provided on a portion of the semiconductor layer 3, the portion excluding a channel region RgCH. That is to say, on the channel region RgCH of the semiconductor layer 3, the ohmic contact film 4 is not provided.

Note that a portion of the semiconductor layer 3, on which the ohmic contact film 4 is provided, functions as source-drain regions of the switching element SW1, which sandwich the channel region RgCH therebetween. Moreover, in FIG. 4, a left-side portion of the channel region RgCH, the left-side portion belonging to the semiconductor layer 3 on which the ohmic contact film 4 is provided, is the source region. Moreover, the ohmic contact film 4 is provided on the semiconductor layer 3. A right-side portion of the channel region RgCH, the right-side portion belonging to the semiconductor layer 3 concerned, is the drain region.

The ohmic contact film 4 is composed of n-type amorphous silicon, n-type polycrystalline silicon or the like. The n-type amorphous silicon, the n-type polycrystalline silicon or the like is silicon doped with impurity such as phosphorous (P) at a high concentration.

On the ohmic contact film 4, the source electrode Se and the drain electrode De are provided. Specifically, the source electrode Se is provided on the ohmic contact film 4 corresponding to the source region of the semiconductor layer 3.

Moreover, the drain electrode De is provided on the ohmic contact film 4 corresponding to the drain region of the semiconductor layer 3. In accordance with such a configuration, the channel-etched-type switching element SW1 is composed.

Note that, in a similar way to the ohmic contact film 4, the source electrode Se and the drain electrode De are not provided on the channel region RgCH of the semiconductor layer 3. Moreover, the source electrode Se extends to an outside of the channel region RgCH of the semiconductor layer 3. As shown in FIG. 3, the source electrode Se is connected to the source wire SL.

Note that the source wire SL is provided so as to extend in the Y-axis direction. Hence, a part of the source wire SL extends in the X direction at a crossing of the source wire SL concerned and the gate wire GL. A part of the source wire SL, which extends in the X direction, is the source electrode Se.

The source electrode Se, the drain electrode De and the source wire SL are formed in the same layer. Each of the source electrode Se, the drain electrode De and the source wire SL is a metal pattern composed of the same material.

Each of the source electrode Se, the drain electrode De and the source wire SF is composed of, for example, a lower layer and an upper layer on the lower layer. The lower layer is formed of a conductive film. For example, the conductive film concerned is composed of high-melting-point metal, low-resistance metal or the like. Moreover, for example, the conductive film may be composed of an alloy film or a laminated film. The alloy film is a film containing the high-melting-point metal, the low-resistance metal or the like as a main component. The laminated film is a film in which pieces of the high-melting-point metal, the low-resistance metal or the like are laminated on each other. For example, the conductive film is composed by using Cr, Al, Ta, Ti, Mo, W, Ni, Cu, Au, or Ag. For example, the upper layer is a metal film containing Al as a main component.

Moreover, the drain electrode De extends to the outside of the channel region RgCH of the semiconductor layer 3. The drain electrode De is electrically connected to the pixel electrode GE1.

In this preferred embodiment, an end portion of the pixel electrode GE1 directly overlaps an end portion of the drain electrode De. That is to say, a lower surface of the end portion of the pixel electrode GE1 directly contacts an upper surface of the end portion of the drain electrode De. That is, the pixel electrode GE1 is provided so that, when viewed as a plane (XY plane) from the above, a part of the pixel electrode GE1 concerned can overlap a part of the drain electrode De.

Moreover, the pixel electrode GE1 extends to an inside of the pixel Px from the upper portion of the end portion of the drain electrode De. As shown in FIG. 3, such pixel electrodes GE1 are provided on most of rectangular regions (pixels Px) formed of the plurality of gate wires GL and the plurality of source wires SL.

In such a way, the pixel electrode GE1 directly overlaps the end portion of the drain electrode De without interposing an insulating film therebetween. In accordance with this configuration, a contact hole for electrically connecting the pixel electrode GE1 to the drain electrode De becomes unnecessary. Hence, it is not necessary to provide an area where the contact hole for connecting the pixel electrode GE1 to the drain electrode De is disposed, and accordingly, an aperture ratio of the substrate 110 can be increased.

Hereinafter, a part of the pixel electrode GE1, which is present on the end portion of each of the drain electrodes De, is also referred to as a "transparent conductive film pattern Pt1". Moreover, hereinafter, each of the pixel electrodes GE1, which are present on most of the rectangular regions (pixels Px) formed of the plurality of gate wires GL and the plurality of source wires SL, is also referred to as a "transparent conductive film pattern Pt2".

In the above description, it is assumed that each of the pixel electrodes GE1 is one in which the transparent conductive film pattern Pt1 and the transparent conductive film pattern Pt2 are integrated with each other. Note that the transparent conductive film pattern Pt1 and the transparent conductive film pattern Pt2 are individually composed of transparent conductive film which are the same material. Moreover, the transparent conductive film pattern Pt1 and the transparent conductive film pattern Pt2 are individually formed in the same layer.

However, the transparent conductive film pattern Pt2 substantially functions as the pixel electrode GE1. Therefore, the transparent conductive film pattern Pt1 may be distinguished from the pixel electrode GE1.

Moreover, it can be interpreted that, for another pixel electrode GE1 adjacent to the transparent conductive film pattern Pt2 that substantially functions as the pixel electrode GE1, the transparent conductive film pattern Pt2 concerned is a transparent conductive film pattern Pt1 present on the same layer as the other pixel electrode GE1 concerned. Therefore, it may be interpreted that the whole of the transparent conductive film pattern Pt1 is the transparent conductive film pattern without allowing the transparent conductive film pattern Pt1 to be distinguished from the pixel electrode GE1.

Moreover, on the switching element SW1 and the pixel electrode GE1, the insulating film 9 as an upper insulating film is provided. The insulating film 9 is provided so as to cover the switching element SW1 and the pixel electrode GE1. For example, the insulating film 9 functions as a protection film of the switching element SW1. For example, the insulating film 9 is composed of silicon nitride, silicon oxide or the like. Note that the insulating film 9 may be composed of a coating-type insulating film. Moreover, the insulating film 9 may be composed of a film in which pieces of silicon nitride, silicon oxide or the like are laminated on each other.

Moreover, in this preferred embodiment, on the pixel electrode GE1, a counter electrode CE1 as the common electrode is provided through the insulating film 9. The counter electrode CE1 is provided so as to be opposite to the respective pixel electrode GE1 through the insulating film 9. In the counter electrode CE1, slits SLt for generating the fringe field are provided between the counter electrode CE1 concerned and the pixel electrode GE1.

In the configuration as described above, the display device 500 (display panel 100) generates the fringe field between the pixel electrode GE1 and the counter electrode CE1, and drives the liquid crystal layer 30. In this way, the display panel 100 of the mode can be composed.

Note that the pixel electrode GE1 and the counter electrode CE1 are insulated from each other by the insulating film 9. Therefore, the insulating film 9 also functions as an interlayer insulating film.

Note that, as shown in FIG. 3, each of the counter electrodes CE1 is provided with respect to the plurality of pixels Px arrayed in a column direction (Y-axis direction). The counter electrode CE1 extends in the column direction (Y-axis direction). The counter electrode CE1 is composed of a transparent conductive film of ITO or the like.

Note that such a configuration of the counter electrode CE1 is not limited to the configuration shown in FIG. 3. For example, the counter electrode CE1 may be configured so that one counter electrode CE1 can be provided with respect to the whole of the display region Rg1.

Figure 5:
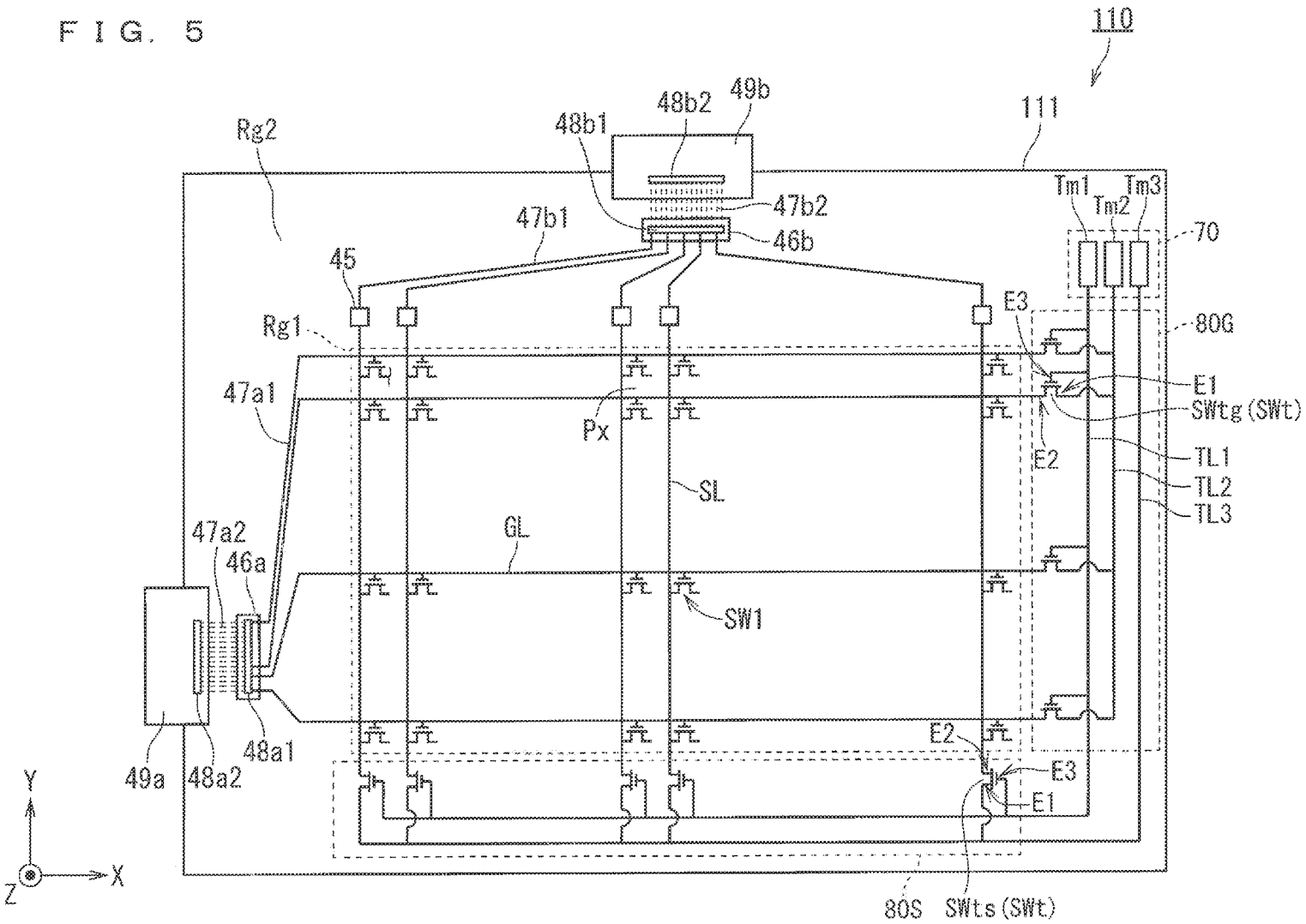
FIG. 5 is a view for explaining an inspection configuration.

Moreover, in the display device 500 of this preferred embodiment, an inspection configuration is further provided. The inspection configuration concerned is provided on the substrate 110. Next, a description will be made of the inspection configuration in detail. FIG. 5 is a view for explaining the inspection configuration.

Referring to FIG. 5, on the peripheral region Rg2 of the transparent substrate 11 of the substrate 110, an inspection terminal portion 70 and inspection circuit portions 80G and 80S are provided.

The inspection terminal portion 70 includes terminals Tm1, Tm2 and Tm3. The inspection circuit portion 80G and the inspection circuit portion 80S are circuits for inspecting the constituents (switching element SW1) and the like, which are connected to the gate wires GL and the source wires SL.

The inspection circuit portion 80G includes n pieces of switching elements SWtg. The n pieces of switching elements SWtg are connected to the n pieces of gate wires GL, respectively.

The inspection circuit portion 80S includes s pieces of switching elements SWts. The s pieces of switching elements SWts are connected to the s pieces of source wires SL, respectively.

Hereinafter, each of the switching element SWtg and switching element SWts is also referred to as "switching element SWt". The switching element SWt is elements for inspecting states of the switching element SW1. That is to say, the switching element SWt is switching element for inspection. Such a switching element SWt included in each of the inspection circuit portion 80G and the inspection circuit portion 80S is, for example, an N-channel-type MOSFET.

The switching element SWt has the same configuration as that of the above-mentioned switching element SW1. That is to say, the switching element SWt has a drain electrode E1, a source electrode E2 and a gate electrode E3. Hereinafter, a state where the drain electrode E1 and the source electrode E2 of the switching element SWt are electrically connected to each other is also referred to as an "ON state". Hereinafter, a state where the drain electrode E1 and the source electrode E2 of the switching element SWt are not electrically connected to each other is also referred to as an "OFF state". The ON state and the OFF state are present in a state of the switching element SWt. Note that each switching element SWt may be a P-channel-type MOSFET.

Hereinafter, each of the switching element SW1 and switching element SWt is also referred to as "switching element SW". The switching element SW is any of the switching element SW1, the switching element SWtg and the switching element SWts.

Hereinafter, a voltage for turning the state of the switching element SW to the ON state is also referred to as a "voltage V1". Moreover, hereinafter, a voltage for turning the state of the switching element SW to the OFF state is also referred to as a "voltage V0". The gate electrode Ge (gate electrode E3) of the switching element SW is an electrode to be selectively applied with the voltage V1 and a voltage V0.

The terminal Tm1 is connected to the gate electrode E3 of each of the n pieces of switching elements SWtg, which are included in the inspection circuit portion 80G, through a wire TL1. The source electrodes E2 of the n pieces of switching elements SWtg are connected to the n pieces of gate wires GL, respectively. Each of the gate wires GL is connected to the gate electrode E3 of each of the switching elements SW1. That is to say, the source electrode E2 of each of the switching elements SWtg is connected to the gate electrode Ge of the switching element SW1 through the gate wire GL. That is to say, the source electrode E2 of each of the switching elements SWtg is connected to the switching element SW1.

Moreover, the terminal Tm1 is connected to the gate electrode E3 of each of the s pieces of switching elements SWts, which are included in the inspection circuit portion 80S, through the wire TL1. The source electrodes E2 of the s pieces of switching elements SWts are connected to the s pieces of source wires SL, respectively. Each of the source wires SL is connected to the source electrode Se of each of the switching elements SW1. That is to say, the source electrode E2 of each of the switching elements SWts is connected to the source electrodes Se of the switching elements SW1 through the source wires SL. That is to say, the source electrode E2 of each of the switching elements SWts is connected to the switching element SW1.

The terminal Tm2 is connected to the drain electrode E1 of each of the n pieces of switching elements SWtg, which are included in the inspection circuit portion 80G, through a wire TL2. The terminal Tm3 is connected to the drain electrode E1 of each of the s pieces of switching elements SWts, which are included in the inspection circuit portion 80S, through a wire TL3.

Note that the display device 500 displays a video by driving (turning ON) the plurality of switching elements SW1. Specifically, on the display region Rg1, the display device 500 displays the video by controlling the scanning signal drive circuit 46*a* and the display signal drive circuit 46*b* by driving the plurality of switching elements SW1 included in the display region Rg1. That is to say, the plurality of switching elements SW1 included in the display region Rg1 are used for displaying the video.

Hereinafter, a period while the display device 500 is displaying the video is also referred to as a "display period Td" or "Td", Moreover, hereinafter, the video which the display device 500 displays is also referred to as a "video Img". For example, the video Img is a moving picture. For example, the video Img is expressed in such a manner that the display device 500 sequentially displays a plurality of frames which are static images.

Hereinafter, a period while an n-th frame among the plurality of frames is displayed is also referred to as a "period Tmn". Hereinafter, a period while an (n+1)-th frame among the plurality of frames is displayed is also referred to as a "period Tm(n+1)". Moreover, hereinafter, a period between the period Tmn as the display period Td and the period Tm(n+1) as the display period Td is also referred to as a "vertical blanking period Tvb" or "Tvb". That is to say, the display period Td and the vertical blanking period Tvb are generated alternately and repeatedly. The vertical blanking period Tvb is also referred to as a vertical fly-back period.

Hereinafter, among then pieces of gate wires GL on the display region Rg1, an (natural number)-th gate wire GL is also referred to as a "gate wire GLm". "m" is any number within a range from 1 to n. Moreover, hereinafter, a gate signal supplied to the m-th gate wire GL is referred to as a "gate signal Gm" or "Gm". For example, the gate signal G2 is a gate signal supplied to a second gate wire GL.

Figure 6:
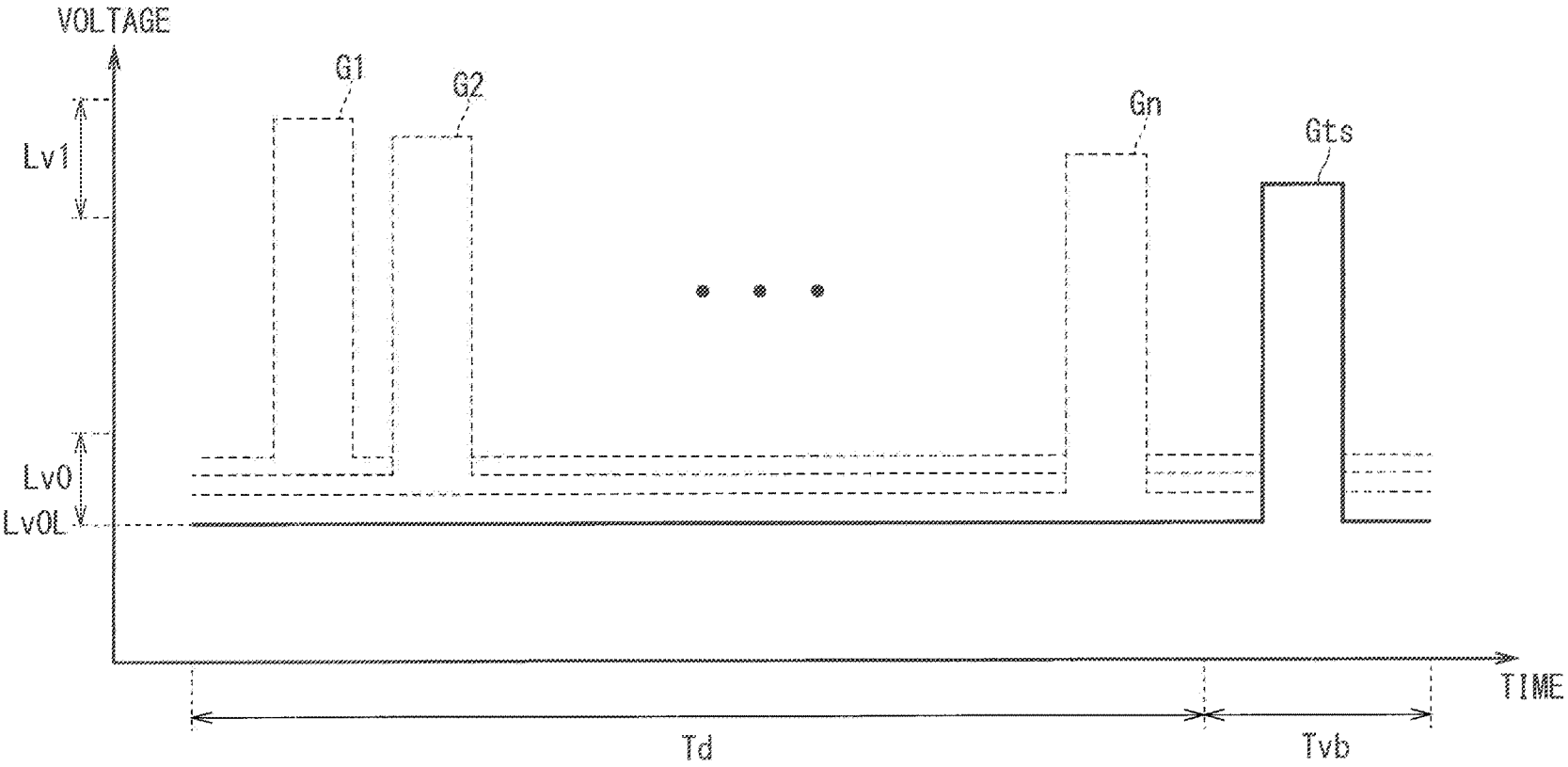
FIG. 6 is a view for explaining processing performed by the display device according to the first preferred embodiment of the present invention.

FIG. 6 is a view for explaining processing performed by the display device 500 according to the first preferred embodiment of the present invention.

Hereinafter, a level of the voltage V1 for turning the state of the switching element SW to the ON state is also referred to as an "ON level Lv1" or "Lv1". As mentioned above, the switching element SW is any of the switching element SW1, the switching element SWtg and the switching element SWts. The ON level Lv1 indicates plural types of values (for example, positive real numbers). For example, the ON level Lv1 is a level within a range from 10 V to 20 V.

Moreover, hereinafter, a level of the voltage for turning the state of the switching element SW to the OFF state is also referred to as an "OFF level Lv0" or "Lv0". For example, the OFF level Lv0 is a level within a range from −20 V to −10 V.

Hereinafter, among values which the OFF level Lv0 indicates, a level of a voltage for turning the state of the switching element SW to the OFF state most surely is also referred to as a "level Lv0L" or "Lv0L". In a case where the switching element SW is an N-channel-type MOSFET, then for example, the level Lv0L is a smallest value (for example, −20 V) among the values which the OFF level Lv0 indicates.

In the display period Td, the display device 500 performs video display processing. The display period Td corresponds to a period while the display device 500 is displaying one frame (static image).

In the video display processing, the scanning signal drive circuit 46*a* sequentially supplies the gate signals Gm (G1 to Gn) to the n pieces of gate wires GL. As shown in FIG. 6, the gate signals G1 to Gn are pulse signals. The pulse signals concerned are signals having a voltage of the ON level Lv1. In this way, the voltage of the ON level Lv1 is supplied to at least one gate wire GL.

Moreover, based on the display data from the outside, the display signal drive circuit 46*b* supplies the display signal to a part or all of the s pieces of source wires SL. Hence, the display voltage corresponding to the display data can be supplied to each of the pixels Px. In this way, the display device 500 displays the video, which is based on the display data, on the display region Rg1.

Hereinafter, in the display device 500, the voltage V0 for turning the state of the switching element SW1 to the OFF state in the display period Td is also referred to as a "voltage V0*a*". The voltage V0*a* is a voltage indicating the level Lv0L.

Moreover, in the display period Td, the display device 500 of this preferred embodiment applies the voltage V0*a* to the gate electrodes E3 of all of the switching elements SWt.

Specifically, in the display period Td, the display device 500 applies the voltage V0*a* to the terminal Tm1.

In this way, the voltage V0*a* indicating the level Lv0L is supplied to the gate electrode E3 of each of the plurality of switching elements SWt, which are included in each of the inspection circuit portions 80G and 80S, through the wire TL1. Hence, the state of each of the switching elements SW can be surely turned to the OFF state. As a result, in the display period Td while the video is displayed, a current (leak current) can be surely prevented from flowing from each of the switching elements SWt to the switching elements SW1 in the display region Rg1.

Moreover, the display device 500 of this preferred embodiment performs inspection processing Pts for inspecting the state of each of the switching elements SW1. The inspection processing Pts is also processing for determining whether or not the switching element SW1 is out of order.

In the inspection processing Pts, the display device 500 supplies the control signal to the terminal Tm1. The control signal concerned is a signal having a voltage of the ON level Lv1. In this way, the control signal is supplied to the gate electrode E3 of each of the plurality of switching elements SWt, which are included in each of the inspection circuit portions 80G and 80S, through the wire TL1. That is to say, the voltage of the ON level Lv1 is applied to the gate electrodes E3 of the plurality of switching elements SWt included in each of the inspection circuit portions 80G and 80S.

As a result, the state of the plurality of switching elements SWt turns to the ON state. In this state, the display device 500 supplies an inspection signal Sg to the terminal Tm2, and supplies a display signal to the terminal Tm3. The inspection signal Sg concerned is a signal having a voltage of the ON level Lv1. For example, the display signal concerned is a signal having a voltage for displaying a solid image (white image) on the display region Rg1.

The inspection signal Sg is supplied to the terminal Tm2, whereby the inspection signal Sg concerned is supplied to the n pieces of gate wires GL through the wire T2 and the n pieces of switching elements SWtg. As a result, the state of the switching elements SW1 connected to each of the n pieces of gate wires GLm turns to the ON state.

Moreover, the display signal is supplied to the terminal Tm3, whereby the display signal concerned is supplied to the s pieces of source wires SL through the wire TL3 and the s pieces of switching elements SWts.

That is to say, the signal that has the voltage corresponding to the solid image is supplied to the respective switching elements SW1 included in the display region Rg1. In this way, it can be determined whether or not each of the switching elements SW1 is out of order. For example, in a case where one pixel Px among the plurality of pixels Px included in the display region Rg1 does not emit light, it is understood that such a switching element SW1 corresponding to the pixel Px, which does not emit light, is out of order.

(Characteristic Processing)

Next, a description will be made of characteristic processing of this preferred embodiment (hereinafter, also referred to as "display stabilization processing Pr1"). Hereinafter, a control signal for use in the display stabilization processing Pr1 is also referred to as a "control signal Gts" or "Gts".

Referring to FIG. 6, the control signal Gts is a pulse signal that has the voltage V1 indicating the ON level Lv1. Note that a period corresponding to a width of the pulse signal concerned is a period shorter than the vertical blanking period Tvb.

In the display stabilization processing Pr1, the display device 500 performs voltage application processing in the vertical blanking period Tvb.

Moreover, during the vertical blanking period Tvb, the display device 500 performs processing for turning the levels of the voltages of all of the gate wires GL of the display region Rg1 to the OFF level Lv0. That is to say, the vertical blanking period Tvb is a period while the levels of the voltages of all of the gate wires GL of the display region Rg1 are the OFF level Lv0. That is, the vertical blanking period Tvb is a period while the state of the switching element SW1 connected to each of all of the gate wires GL of the display region Rg1 is the OFF state.

In the voltage application processing, the display device 500 applies the voltage V1, which indicates the ON level Lv1, to the gate electrode E3 of the switching element SWt in the vertical blanking period Tvb. Specifically, in the voltage application processing, the display device 500 supplies the control signal Gts, which has the voltage V1 of the ON level Lv1, to the terminal Tm1 in the vertical blanking period Tvb. In this way, the control signal Gts is supplied to the gate electrode E3 of each of the plurality of switching elements SWt, which are included in each of the inspection circuit portions 800 and 80S, through the wire TL1.

As described above, in accordance with this preferred embodiment, in the display period Td, the display device 500 applies the voltage V0*a* of the level Lv0L for turning the state of the switching element SWt to the OFF state to the gate electrode E3 of the switching element SWt concerned. Moreover, in the vertical blanking period Tvb while the state of the switching element SW1 is the OFF state, the display device 500 performs the voltage application processing for applying the voltage V1, which indicates the ON level Lv1, to the gate electrode E3 of the switching element SWt.

Note that the period while the state of the switching element SW1 is the OFF state is a period while the switching element SW1 for use in displaying the video is not used (that is, a period while the video is not displayed). In this way, there can be suppressed prolongation of a period while the same-level voltage is applied to the switching element SWt for inspecting the state of the switching element SW1.

Note that, in general, as the period while the same-level voltage (for example, a negative voltage) is applied to the switching element SWt is longer, a change of a threshold value (Vth) of the switching element SWt concerned becomes larger. In this preferred embodiment, there can be suppressed the prolongation of the period while the same-level voltage is applied to the switching element SWt for inspecting the state of the switching element SW1. Therefore, the change of the threshold value (Vth) of the switching element SWt can be suppressed.

Moreover, in this preferred embodiment, in the vertical blanking period Tvb while the video is not displayed, the control signal Gts that has the voltage V1 indicating the ON level Lv1 is supplied to the gate electrode E3 of each of the plurality of switching elements SWt, which are included in each of the inspection circuit portions 80G and 80S, through the wire TL1. This processing does not affect quality of the video which the display device 500 displays.

Hereinafter, a value between a value (Lv0L) of the voltage V0*a* and a value (Lv1) of the voltage V1 is also referred to as a "level Lv01" or "Lv01.". Moreover, hereinafter, a voltage that indicates the level Lv01 is also referred to as a "voltage V01". Here, it is assumed that Lv0L is −20 V, and that Lv1 is a value within a range from 10 V to 20 V. In this case, the level Lv01 is a value within a range from −19 V to 9 V.

Note that the control signal Gts is not limited to the pulse signal that has the voltage V1 of the ON level Lv1. The control signal Gts may have a configuration (hereinafter, also referred to as a "configuration Ct1") of being a pulse signal that has the voltage V01 indicating the level Lv01. In the case where the switching element SW is an N-channel-type MOSFET, the level Lv01 is a value larger than Lv0L.

In the configuration Ct1, in the display period Td, the display device 500 applies the voltage V0*a* for turning the state of the switching element SWt to the OFF state to the gate electrode E3 of the switching element SWt concerned. Moreover, in voltage application processing to which the configuration Ct1 is applied, the display device 500 applies the voltage V01, which indicates the level Lv01, to the gate electrodes E3 of the plurality of switching elements SWt, which are included in each of the inspection circuit portions 80G and 80S, in the vertical blanking period Tvb.

In this way, the above-mentioned effect is also obtained in the configuration Ct1. Therefore, the change of the threshold value (Vth) of each of the switching elements SWt can be suppressed.

Note that the voltage V1 that indicates the ON level Lv1 is assumed to be applied to the wire TL1 in the display period Td. In this case, the level of the voltage of the gate wire GL is the ON level Lv1, and the state of each of the switching elements SW1 connected to the gate wire GL concerned is the ON state. Moreover, the voltage V1 is applied to the pixel electrode GE1 through the source wire SL and the switching element SW1. Therefore, there occurs a malfunction that quality of the video displayed on the display region Rg1 decreases.

Meanwhile, in this preferred embodiment, the voltage V1 is applied to the wire TL1 in the vertical blanking period Tvb. Moreover, in this preferred embodiment, the voltage V1 is not applied to the wire TL1 during the display period Td. Therefore, the above-described malfunction can be prevented from occurring.

Note that, in this preferred embodiment, it is assumed that the switching element SW is an N-channel-type MOSFET; however, the switching element SW may be a P-channel-type MOSFET composed of polycrystalline silicon and the like. In this case, a magnitude relationship among the respective voltages in the above-mentioned configuration using the control signal Gts is reversed, whereby a similar effect to the above is obtained.

Note that, in Related Art A mentioned above, when the liquid crystal display panel (liquid crystal display device) is driven, a constant voltage for turning the inspection switching elements to the OFF state is applied to the inspection switching elements concerned. In this case, during the drive of the liquid crystal display device, such an ON-level voltage or such an OFF-level voltage is applied to each of the switching elements in the display region. Note that only the OFF-level voltage is applied to each of the inspection switching elements.

In this case, an aged change of the threshold value of the inspection switching element becomes larger than that of the switching element of the display region. Therefore, there is a problem that a display malfunction occurs owing to a leak current of the inspection switching element.

Moreover, in Related Art A, such processing for increasing the threshold value of the inspection switching element more than that of the switching element of the display region at the time when the liquid crystal display device is driven is performed after the inspection of the liquid crystal display device. Note that there is a problem that it takes a time to execute the processing concerned, resulting in an increase of cost.

Moreover, in a case where the inspection switching element is a back-channel-etched-type TFT, if a threshold value of the inspection switching element concerned is set too high, then the leak current of the inspection switching element concerned becomes large. Therefore, there is also a problem that it is difficult to control the processing for increasing the threshold value of the switching element.

In this connection, the display device 500 of this preferred embodiment can solve the above-described problem since the display device 500 is configured as described above. Hence, the display device 500, which saves cost and is highly reliable, can be obtained.

Modification Example of First Preferred Embodiment

A configuration of a modification example of this preferred embodiment is a configuration in which a period while the voltage application processing is performed is set to a period different from the vertical blanking period Tvb (hereinafter, this configuration is also referred to as a "configuration Ct2"). A display device in the configuration Ct2 is the display device 500 of the first preferred embodiment.

In the configuration Ct2, the video Img includes a static image (frame). Hereinafter, a period for allowing the display device 500 to display the whole of one static image (frame) is also referred to as a "display period Tds". The display period Tds includes a plurality of horizontal blanking periods Thb (horizontal fly-back periods). Hereinafter, each of the horizontal blanking periods Thb is also simply referred to as "Thb".

Figure 7:
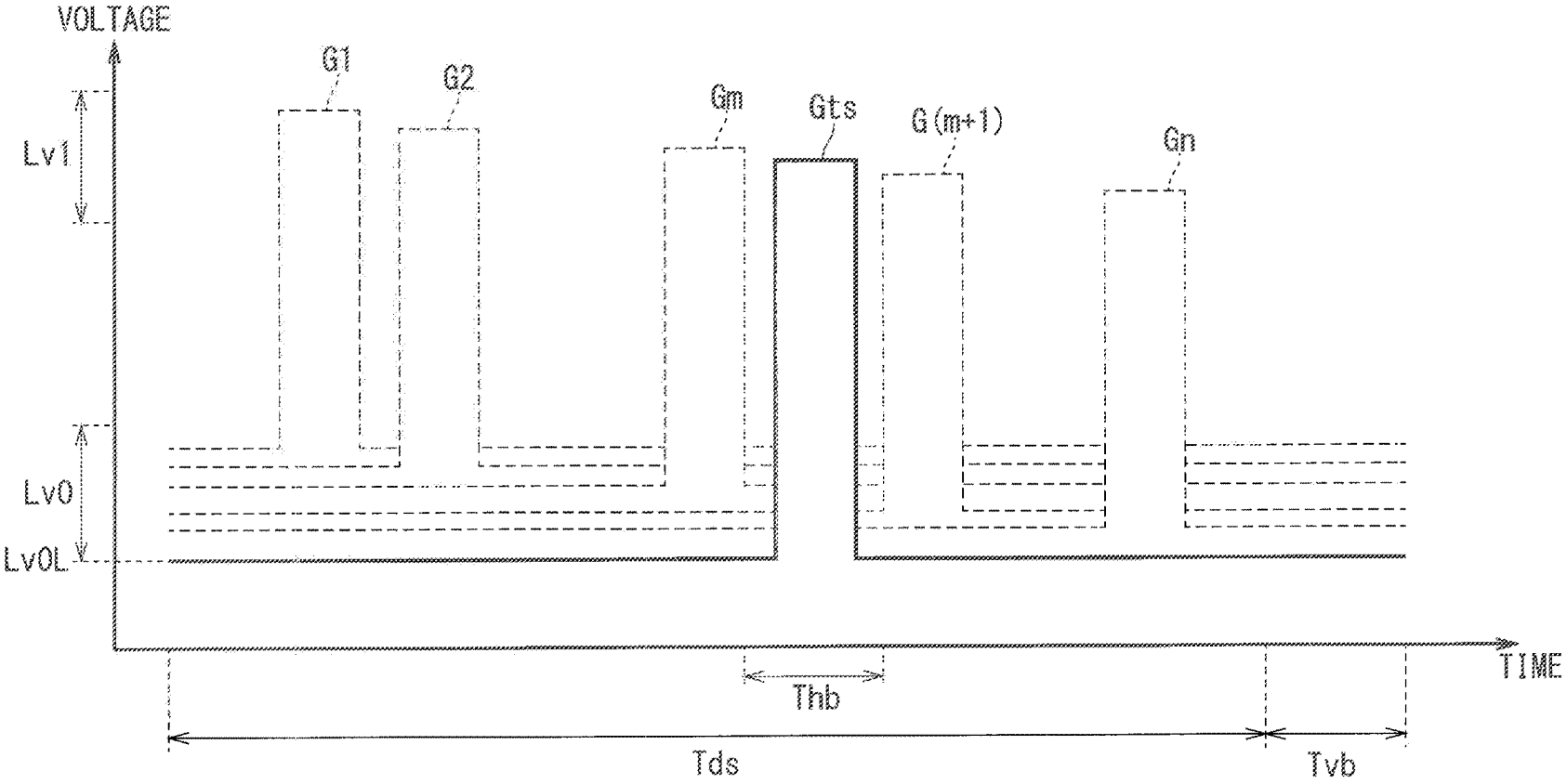
FIG. 7 is a view for explaining processing in a modification example of the first preferred embodiment.

FIG. 7 is a view for explaining processing in the modification example of the first preferred embodiment. Note that FIG. 7 shows only one horizontal blanking period Thb in order to make it easy to be viewed. Note that, in FIG. 7, a description of the same terms as the terms shown in FIG. 6 is omitted.

The horizontal blanking period Thb is a period between a period while the gate signal Gm is generated and a period while the gate signal G(m+1) is generated. Hereinafter, in the display period Tds, a period other than the horizontal blanking period Thb is referred to as a "display period Tdx". The display period Tdx is a period while the display device 500 is displaying a video (static image).

In the configuration Ct2, in the period (display period Tdx) other than the horizontal blanking period Thb in the display period Tds, the display device 500 applies the voltage V0*a*, which indicates the level Lv0L, to the gate electrodes E3 of all of the switching elements SWt in a similar way to the first preferred embodiment.

In the configuration Ct2, the inspection processing Pts is performed in a similar way to the first preferred embodiment.

Moreover, in display stabilization processing Pr1 to which the configuration Ct2 is applied, the display device 500 performs voltage application processing in the horizontal blanking period Thb.

Moreover, in the display stabilization processing Pr1 to which the configuration Ct2 is applied, during the horizontal blanking period Thb, the display device 500 performs the processing for turning the levels of the voltages of all of the gate wires GL of the display region Rg1 to the OFF level Lv0. That is to say, the horizontal blanking period Thb is a period while the levels of the voltages of all of the gate wires GL of the display region Rg1 are the OFF level Lv0. That is, the horizontal blanking period Thb is a period while the state of the switching element SW1 connected to each of all of the gate wires GL of the display region Rg1 is the OFF state.

In the voltage application processing to which the configuration Ct2 is applied, the display device 500 applies the voltage V1, which indicates the ON level Lv1, to the gate electrode E3 of the switching element SWt in the horizontal blanking period Thb.

Specifically, in the voltage application processing to which the configuration Ct2 is applied, the display device 500 supplies the control signal Gts, which has the voltage V1 of the ON level Lv1, to the terminal Tm1 in the horizontal blanking period Thb. In this way, the control signal Gts is supplied to the gate electrode E3 of each of the plurality of switching elements SWt, which are included in each of the inspection circuit portions 80G and 80S, through the wire TL1.

Also in the display stabilization processing Pr1 to which the above-described configuration Ct2 is applied, a similar effect to that of the first preferred embodiment is obtained. That is to say, there can be suppressed the prolongation of the period while the same-level voltage is applied to the switching element SWt for inspecting the state of the switching element SW1. Moreover, the change of the threshold value (Vth) of each of the switching elements SWt can be suppressed.

Note that the control signal Gts for use in the voltage application processing to which the configuration Ct2 is applied may be not the pulse signal that has the voltage V1 of the ON level Lv1, but a pulse signal that has the voltage V01 indicating the level Lv01 in a similar way to the configuration Ct1 of the first preferred embodiment. That is to say, in the voltage application processing to which the configuration Ct2 is applied, the display device 500 may apply the voltage V01, which indicates the level Lv01, to the gate electrodes E3 of the switching elements SWt in the horizontal blanking period Thb.

As mentioned above, the level Lv01 concerned is a value between the value (Lv0L) of the voltage V0*a* and the value (Lv1) of the voltage V1. Also in this configuration, a similar effect to the above is obtained.

Note that, in the present invention, within the scope of the invention concerned, it is possible to freely combine preferred embodiments and modification examples of the preferred embodiments, and to appropriately modify and omit the preferred embodiments and the modification examples of the preferred embodiments.

For example, the configuration Ct2 may be set to a configuration applied to the display stabilization processing Pr1 of the first preferred embodiment (hereinafter, this configuration is also referred to as "configuration Ct12"). In the display stabilization processing Pr1 to which the configuration Ct12 is applied, the display device 500 performs the voltage application processing of the first preferred embodiment in the vertical blanking period Tvb, and the display device 500 performs the above-mentioned voltage application processing, to which the configuration Ct2 is applied, in the horizontal blanking period Thb.

Note that, in the configuration Ct12, during each of the vertical blanking period Tvb and the horizontal blanking period Thb, the display device 500 performs the processing for turning the levels of the voltages of all of the gate wires GL of the display region Rg1 to the OFF level Lv0. In this way, the vertical blanking period Tvb and horizontal blanking period Thb of the configuration Ct12 are periods while the state of the switching element SW1 is the OFF state.

Moreover, in the configuration Ct12, during the display period Tdx, the display device 500 applies the voltage V0*a* to the gate electrodes E3 of all of the switching elements SWt in a similar way to the first preferred embodiment.

In this way, also in the configuration Ct12, a similar effect to that of the first preferred embodiment or the modification example of the first preferred embodiment is obtained.

Moreover, for example, in the first preferred embodiment or the modification example of the first preferred embodiment, in the period (Tvb, Thb) while the control signal Gts is applied, the levels of the voltages of all of the gate wires GL of the display region Rg1 are set to the OFF level Lv0; however, are not limited to this.

For example, a configuration may be made, in which the voltage is not applied to the source wire SL even if the level of the voltage of each of the gate wires GL is the ON level Lv1. In the configuration concerned, for example, another switching element is provided between the switching element Swt and the switching element SW1. The other switching element concerned is an element for preventing a voltage from being applied to the source wire SL even if the level of the voltage of each gate wire GL is the ON level Lv1. In the configuration concerned, if a state of the other switching element is the OFF state in the period other than the display period Td, then the control signal Gts can be applied to the gate electrode of the switching element SWt even if the level of the voltage of the gate wire GL is the ON level Lv1.

Moreover, such a configuration may be adopted, in which the slits SD are not provided in the counter electrode CE1. In the configuration concerned, the shape of the counter electrode CE1 is comb teeth-like.

While the invention has been shown and described in detail, the foregoing description is in all aspects illustrative and not restrictive. It is therefore understood that numerous modifications and variations can be devised without departing from the scope of the invention.

What is claimed is:

1. A display device that displays a video to be viewed by a user, comprising:

a first switching element for use in displaying said video; and a second switching element for inspecting a state of said first switching element, wherein said display device displays said video by driving said first switching element, a switching element that is each of said first switching element and said second switching element has a first electrode, a second electrode and a third electrode, a state of said switching element includes:

an ON state where said first electrode and said second electrode of the switching element are electrically connected to each other; and an OFF state where the first electrode and second electrode of the switching element are not electrically connected to each other, said third electrode is an electrode to be selectively applied with a first voltage that is a voltage for turning the state of said switching element to said ON state and a second voltage that is a voltage for turning the state of the switching element to said OFF state, said second electrode of said second switching element is connected to said first switching element, in a display period that is a period while said display device is displaying said video, the display device applies an OFF second voltage, which is said second voltage for turning a state of said second switching element that is the switching element to said OFF state, to said third electrode of the second switching element, in a period while a state of said first switching element is said OFF state, said display device performs voltage application processing for applying said first voltage or a third voltage, which indicates a value between a value of said OFF second voltage and a value of the first voltage, to said third electrode of said second switching element, a non-display period that is a period during which said display device does not display said video is a vertical blanking period and a horizontal blanking period, said display device performs said voltage application processing in both or one of:

part of said vertical blanking period, and part of said horizontal blanking period, said display period and said non-display period are generated alternatively and repeatedly, and said display device performs said voltage application processing in a period during which said display device is driving, and during which said display period and said non-display period are generated alternatively and repeatedly.

2. The display device according to claim 1, wherein said video which said display device displays is expressed in such a manner that the display device sequentially displays a plurality of frames which are static images, and said display device performs said voltage application processing in said vertical blanking period that is a period between a period while an n-th frame among said plurality of frames is displayed and a period while an (n+1)-th frame among the plurality of frames is displayed.

3. The display device according to claim 1, wherein said video includes a static image, a period for allowing said display device to display a whole of said static image includes said horizontal blanking period, and said display device performs said voltage application processing in said horizontal blanking period.

4. The display device according to claim 1, wherein said second switching element is for inspecting a state of said first switching element by performing an inspection processing, and during said inspection processing, said display device performs an inspection of said first switching element by supplying said first voltage to said third electrode of said second switching element.

* * * * *